United States Patent [19]

Taylor

[11] 4,073,492

[45] Feb. 14, 1978

[54] CUSTOMIZED PUTTER

[76] Inventor: David L. Taylor, 380 W. Carmel Valley Road, Carmel Valley, Calif. 93924

[21] Appl. No.: 681,542

[22] Filed: Apr. 29, 1976

Related U.S. Application Data

[63] Continuation-in-part of Ser. No. 597,548, July 21, 1975, abandoned.

[51] Int. Cl.[2] ..... A63B 53/02

[52] U.S. Cl. ..... 273/80.2; 273/80 C; 273/167 G

[58] Field of Search ..... 273/77 R, 79, 80 C, 273/80.1–80.8, 164, 167–175

[56] References Cited

U.S. PATENT DOCUMENTS

| | | | |
|---|---|---|---|
| Re. 19,178 | 5/1934 | Spiker | 273/169 X |
| D. 209,149 | 11/1967 | Sowers | 273/164 X |
| D. 231,375 | 4/1974 | Solheim | 273/80 C X |
| 1,250,296 | 12/1917 | Fitzjohn et al. | 273/80 C |
| 1,352,020 | 9/1920 | Olson | 273/79 |
| 1,703,199 | 2/1929 | McClure | 273/164 X |
| 2,146,048 | 2/1939 | Barnhart | 273/80 C |
| 2,171,383 | 8/1939 | Wettlaufer | 273/171 |
| 2,478,468 | 8/1949 | Drake | 273/80.2 |
| 2,708,579 | 5/1955 | Hugman | 273/79 |
| 3,096,982 | 7/1963 | Bassin | 273/80.1 |
| 3,166,320 | 1/1965 | Onions | 273/80 C |
| 3,332,684 | 7/1967 | Solheim | 273/80 C X |

FOREIGN PATENT DOCUMENTS

| | | | |
|---|---|---|---|
| 238,646 | 10/1960 | Australia | 273/80 C |
| 710,688 | 6/1965 | Canada | 273/80 C |
| 1,118,181 | 6/1968 | United Kingdom | 273/80.1 |
| 1,129,314 | 10/1968 | United Kingdom | 273/80.1 |
| 899,562 | 6/1962 | United Kingdom | 273/80 C |
| 1,232,651 | 5/1971 | United Kingdom | 273/80 C |

OTHER PUBLICATIONS

"Golf Digest"; June 1971; p. 122.
"Golf Digest"; Dec. 1972; p. 96.

*Primary Examiner*—Richard J. Apley

[57] ABSTRACT

A customized putter including a shaft bent adjacent the head with a reverse curve, and a head to which the shaft is mounted with a ball and socket joint so that the shaft may be moved orbitally relative to the head to secure the precise position or attitude which is best suited to the stance, address, and other features individual to the owner, face balancing the club in its determined attitude by rotation of the shaft on its own axis in its horizontal balanced position until the striking face is parallel to the ground, such that the center of gravity of the head is below the plane of the longitudinal axis of the shaft in the horizontal balanced position, and then irreversibly securing the head and shaft in the combined attitude and face balanced position. The club is not ready for United States Golf Association play unless and until it is irreversibly locked in the combined attitude and balanced position.

6 Claims, 12 Drawing Figures

CUSTOMIZED PUTTER

This is a continuation-in-part of my application Ser. No. 597,548, filed July 21, 1975, and now abandoned.

BACKGROUND OF THE INVENTION

The putting and the putting stroke are baffling parts of the game of golf. The purpose of this invention is not to make everyone a good putter but to provide the golfer with a club which when properly adjusted in attitude, face balanced, and locked in the resulting position, will provide a putter customized to the individual golfer's needs and desires, and which will give him the confidence required of all good putters.

Up to the present time in the United States Golf Association has declared an adjustable club illegal for tournament play and generally these rules have been adopted by each individual golf course, both public and private, as the rules for play for the members and the everday golfer. This rule has been made necessary to rid the game of golf of gimmicks in which the angle of the striking face to a single club head or the angle of the shaft could be adjusted at any particular time and for any stroke, from a putter to a nine iron. The customized nature of the present putter is such that it does not fun afoul of the Rules of the United States Golf Association, but on the contrary enforces and enhances them. All adjustable positions are permanently locked before the putter is ready for play.

A special reason for making the attachment of the shaft to the head of this putter with a ball and socket joint is to permit the golfer, under the direction of the resident Golf Professional, to position the shaft with respect to the head so that the relationship or attitude can be made to the golfer's own personal requirements. With the attitude set the club is then face-balanced to customize the putter to the individual idiosyncrasies and desires of the user. Once the final face balance is determined, the setting is made irreversible, and in the meantime the putter is not in usable playing condition.

There are many advantages arising from these features, but one of the main ones is that for the first time the golfer is provided with a putter suited to his personal requirements to give him the confidence to putt well and improve his game. This applies to professional golfers and all the way to the once-a-week duffer.

A truly unexpected result is that face balancing enlarges the perfect hitting spot - "the sweet spot", so that the ball may be struck near the toe to near the heel, along the face without diverting the true line to the cup. In other words, a bad putt (away from "the sweet spot") becomes a good putt along the line to the hole. One does not have to hit a perfect putt on the striking face 27 in order to have the ball roll true on the line of the putting stroke. This is another of the great advantages of this particular struction.

Further objects are to provide a construction of maximum simplicity, economy and ease of assembly and disassembly also such further objects, advantages and capabilities as will fully appear and as are inherently possessed by the device and invention described herein.

The invention further resides in the combination, construction and arrangement of parts illustrated in the accompanying drawings, and while there is shown therein a preferred embodiment thereof, it is to be understood that the same is illustrative of the invention and that the invention is capable of modification and change and comprehends other details of construction without departing from the spirit thereof or the scope of the appended claims.

DESCRIPTION OF THE PREFERRED EMBODIMENT

Figure 1:
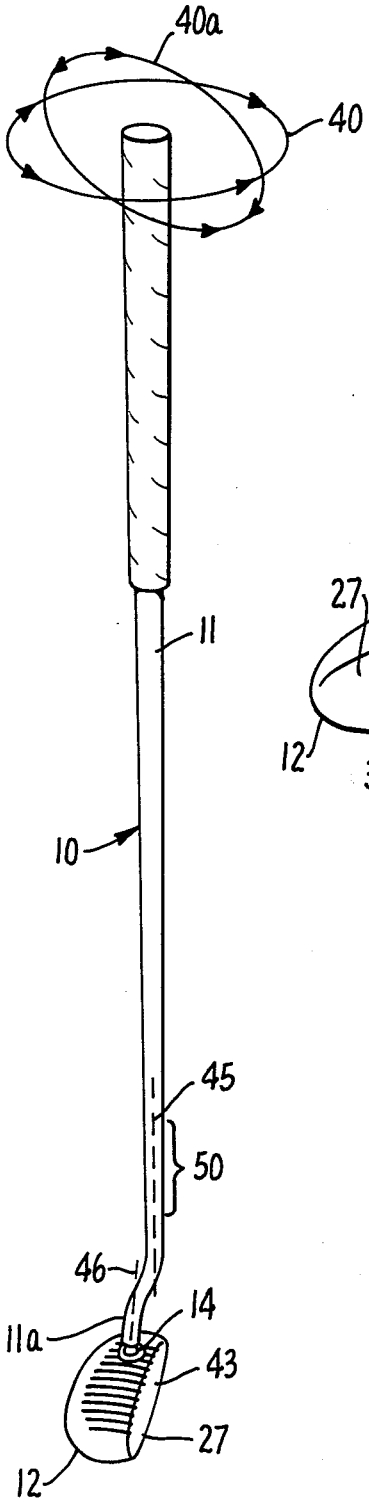
FIG. 1 is a perspective view of the complete golf club showing the putter of the present invention.

Referring now more particularly to the drawing in which like reference numerals indicate like parts in the several views, and with particular reference to FIG. 1, there is shown the complete putter of the present invention in perspective indicated in its entirety as 10. The complete putter shown in FIG. 1 comprises a shaft 11, a head 12, and a ball and socket joint 14 in the head having a radially extended stub portion 16 which together permanently join the shaft 11 to the head 12.

Figure 3:
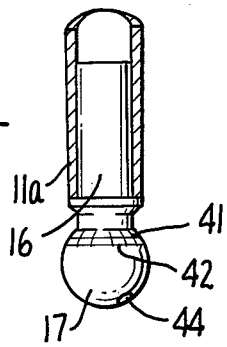
FIG. 3 is an enlarged view of the ball portion of the joint with its extended radial stub.
Figure 2:
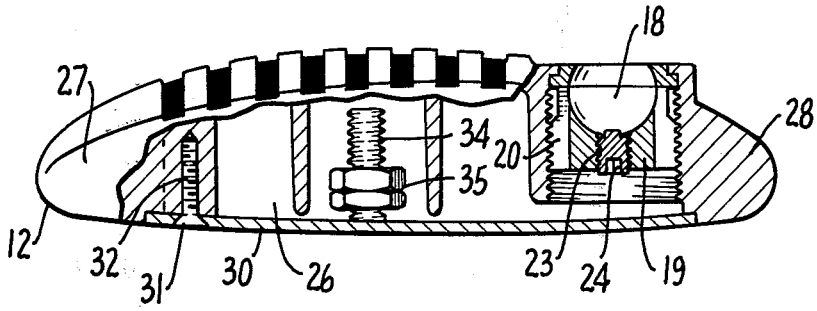
FIG. 2 is an enlarged front view of the putter head partially broken away to show intended sections.
Figure 4:
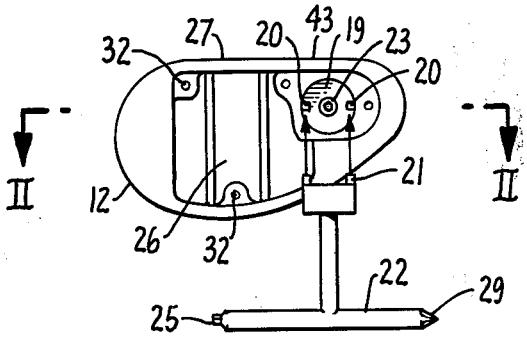
FIG. 4 is a bottom view of the putter head with the sole plate removed.
Figure 5:
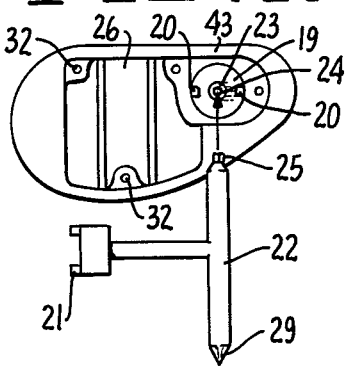
FIG. 5 is also a bottom view of the putter head with the sole plate removed.
Figure 6:
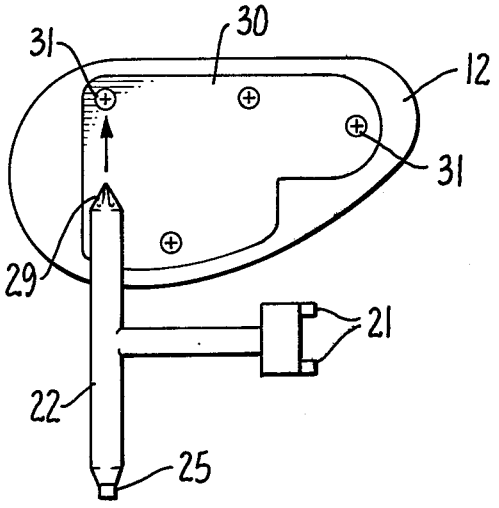
FIG. 6 is a bottom view of the putter head with the sole plate in position.

The head 12 shown in the various views may be characterized as a mallet-type head of pleasing free form shape, but it is to be understood that the invention applies as well to other types of putters. The shaft 11 is mounted on the stub shaft 16 (For details see FIG. 3) after the ball 17 is inserted from below in position in the domed cavity 18 on the interior of the head 12 (See FIG. 2). The shaft 11 is mounted on the stub shaft 16 with a fast setting, permanent adhesive, such as "Loctite", or in any other suitable manner, making the shaft 11 and the ball 17 as a unit, loosely positioned within the cavity or socket 18. A compression plug 19 is threadably mounted within the cavity 18 for bearing against the internal portion of the ball 17 to temporarily hold a position thereof. The compression plug 19, in one form may have two diametrically opposite notches 20 in the perimeter thereof. These notches 20 are spaced apart at a distance co-extensive with the projections 21 of a golf cleat wrench (See FIG. 4). At the center of the compression plug 19, in this instance there is a threaded axial set screw 23 with an axial hex hole 24 for receiving the Allen wrench head 25 on the wrench 22.

The head of the putter 12 has a hollow chamber 26 open at the bottom with land areas at the toe 27*a*, and at the heel 28 where the compression plug 19 is located. The hollow chamber 26 is covered by a sole plate 30. The sole plate 30 is secured in place with a plurality of Phillips screws 31 which fit into holes 32 prepared in the various lands and bosses within the club head. For strengthening the club head in the chamber 26 there may be parallel transverse reinforcing vanes or webs 33, if desired, formed in the chamber of the head 12.

Figure 7:
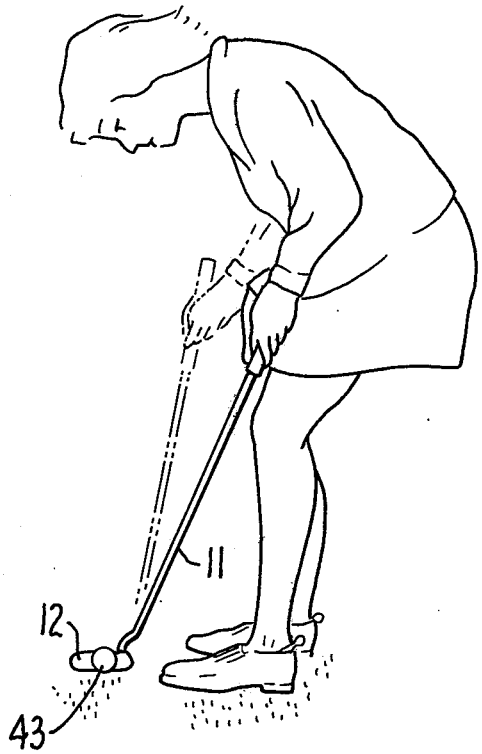
FIG. 7 is an illustration of various adjustments of the shaft with respect to the club head to suit individual golfers.
Figure 8:
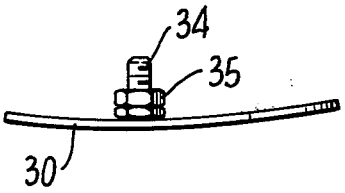
FIG. 8 is a front elevational view of the sole plate.

As before noted, there is shown in conjunction with several views, a special tool 22 which is furnished to the Club Professional which is for use in determining and fitting the proper attitude, or angular relationship of the shaft to the head for any particular golfer (See FIG. 7). This tool 22 has two studs or prongs 21, diametrically spaced in the precise position for use in tightening golf cleats, which also happens to be the precise span required for the compression plug 19. The spanner lug portion of the tool 22 is, for example, shown as the vertical leg of its "T" shape. At one end of the "T" cross bar, is shown the + head 29 of the Phillips screw driver, and at the opposite end of the "T" cross bar is shown the hexagonal shape 25 which fits the Allen head socket of the set screws 23 and 43.

The manner of customizing this club is simple if instructions are followed faithfully and easy to do with multipurpose tool 22 provided, which is all that is needed to accomplish the preliminary fitting. To do this the sole plate 30 is removed. The cleat lugs 21 of the tool 22 are placed in the notches 20 of the compression plug 19, for tightening the bearing pressure against the ball 17 in the socket 18, which is radially offset from the center line 46 of the lower portion of the shaft 11. The plug is tightened against the lower portion of the ball 17 with just enough pressure to firmly hold a position of the shaft but loosely enough to move the shaft 11 with respect to the head, in any orbital direction desired as indicated at 40 and 40*a*. The orbital rotation is generally indicated in FIG. 1, and is accomplished without rotation of the shaft on its own axis 45. Various positions of the shaft-head angular relation should be tried by the golfer to help him decide, with the help of the Golf Professional, which position or attitude is correct for him. The tightening will hold long enough to permit a determination of an appropriate attitude but not long enough to sustain play. If the attempt is made to orbitally move the shaft with respect to the club head several times, the pressure on the ball 17 will loosen and the club head will begin to flop, since it will not hold any position. No matter how tightly the compression plug 19 is held against the ball 17 and the joint 18, if there is an attempt to use the club in play, contrary to the United States Gold Association Rules, the club head will loosen and soon the adjustment will be released and the head will begin to flop around and not hold any position.

When the golfer feels that he has decided upon the proper angular relationship between the shaft 11 and the putter head 12 which fits his particular requirements, this determines the final attitude. In the selected attitude the club is then face balanced. This is accomplished by placing the club in a horizontally balanced position on a balancing block. The club will balance horizontally within the area 50. The shaft is then rotated on its own axis 45 so that in the balanced position in a horizontal plane, the face 27 or striking surface of the putter will be parallel to the ground. The balancing area will always be within that indicated as 50 in FIG. 1, and will always be above the curves so as not to distort or prevent the balancing. Face balancing requires that the club in the horizontal position will balance in the area 50 of FIG. 1. This is beyond the invention described in the co-pending application, Ser. No. 513,564 filed Oct. 10, 1974, which is now U.S. Pat. No. 3,954,265, in that it is accomplished with a ball and socket joint for individual customizing. The club may then be returned to the factory where the club head and shaft, in the precise adjusted positions, are checked and made permanent with micro-face-balancing, which can only be accomplished by the manufacturer. In face balancing as described here the rotation of the shaft 11 on its axis 45 through the reverse curve therein causes the center of gravity of the club head 12 to be below the center line 45 of the shaft. In this finalized position the club head is fixed irreversibly in the precise positions indicated and the putter leaves the factory ready for approved play. The club, therefore, is in every way acceptable for tournament play, and on all courses, in accordance with the United States Golf Association Rules.

Another and new feature of face balancing is accomplished by the reverse curves of the shaft 11. These curves are bent in the same plane within the five (5) inch limitation above the ground surface. The axis 46 of the shaft portion adjacent the head 12 is not parallel to the axis 45 of the shaft itself. This is important because the axis 46 always points directly to "the sweet spot", or preferred striking area of the face 27.

In order to assure the most accurate positioning and adjusting prior to making these adjustments irreversible, the Resident Professional may be supplied with a special club which, of course, would not be approved for play. In this case, the same structure is used, but the visible portion of the ball in the ball and socket joint is engraved with markings, both latitude 41 and 42 longitude, indicating the adjusted position or attitude for the individual golfer. When these have been accomplished under the advice and instruction of the Golf Professional, then the factory may be notified of the precise markings accomplished in these adjustments, and the factory can then customize the fitting precisely to the requirements of the golfer who ordered the club. This is so accurate a method of accomplishing the professional adjustments that there is no delay in making delivery within a matter of a very few days.

With the completion of the club head 12 face balancing on the shaft 11, the sole plate 30 is placed over the cavity 26 of the club head to close the hollow portion with a smooth unobstructed surface. The Phillips screws 31 are placed into the appropriate holes 32 and tightly secured in the lands and bosses on the interior of the club head. The Phillips screws 31 are tightened by the appropriate screw driver end 29 of the tool 22.

It is apparent, therefore, that when the club leaves the factory intended for use on the golf course, all parts are irreversibly locked in the adjusted positions as is required by the United States Golf Association Rules and are completely approved for all types of play.

Since the United States Golf Association Rules prohibit adjustable clubs of any kind, and to help make rulings with respect to the irreversibility of the adjusted positions of the putter disclosed herein, a visual indicator may be provided. A flush Phillips set screw 43 may be used in the face 27 of the head 12. The set screw 43 may be provided with a circular inner end which would cut a ring 44 in the softer metal of the ball 17. Due to the angularity of the shaft mounting, the contact would be offset therefrom, and because of the effective location of the set screw 43 in the face of the putter the contact would be below the horizontal diameter, resulting in a strong cam action. Even if it were possible, which it is not, to remove the set screw 43, there could be no change in the adjustment because the screw 43 would always seek and come to rest in the original setting 44. However, as an abundance of caution some permanent setting adhesive such as "Loctite" is used. Set screw 43 can be used alone or in combination with set screw 23. The flush head of set screw 43 will always be plainly visible on the face of the putter for checking.

A further feature of this club head 12 is the fact that on the inner face of the sole plate 30 there is an upstanding threaded stud 34 which is designed to project into the chamber 26 between the two reinforcing ribs 36 and 37. The threaded stud receives standard ¾ inch nuts 38 and the club is further customized for weight by adding or taking off nuts 38 threaded to the stud 34. This form of adjustment does not violate any rule of the United States Golf Association as it has long been deemed by the Rules Committee as acceptable for tournament and general play.

Another unexpected result of face balancing results from the rotation of the shaft 11. The axis 45 of the straight portion of the shaft 11 is not parallel with the axis 46 of the straight portion **11*a* of the shaft attaching to the stud 16. The included angle between the axis 45 and 46 is from 11° to 16°. In this manner the portion 11*a*, when in the balanced position, will point directly to "the sweet spot" in face 12**.

Figure 9:
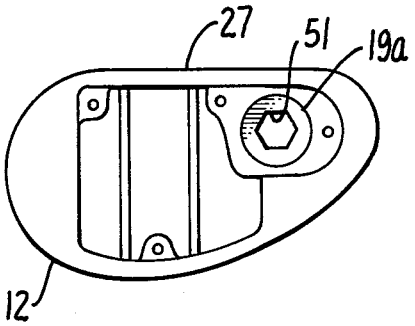
FIG. 9 is a view similar to FIG. 4, but showing the alternate jam nut means with the hexagonal axial opening.
Figure 10:
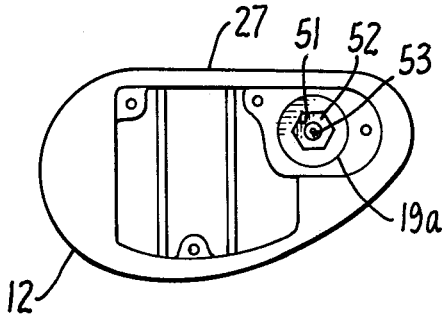
FIG. 10 is a view similar to FIG. 9, with the hexagonal bushing received in the opening of the jam nut.
Figure 11:
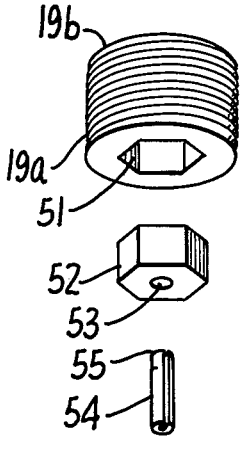
FIG. 11 is an exploded perspective view of a preferred form of irreversible locking means for preserving the selected attitude and balanced position of the club.
Figure 12:
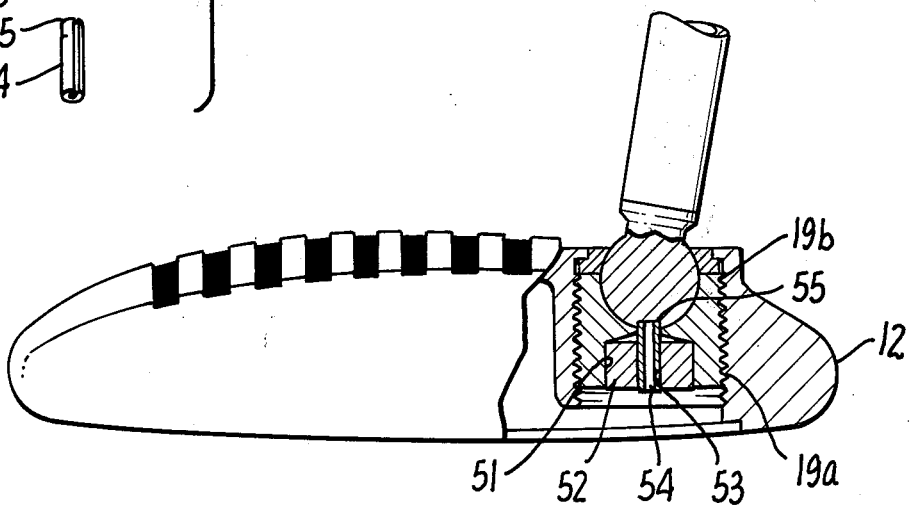
FIG. 12 is a fragmentary vertical section of the irreversible locking showing the penetration of the roll pin.

Referring now more particularly to FIGS. 9, 10, and 11, there is shown therein another preferred form of securing the irreversible locking of the movable mounting means 17 and the shaft 11 to the club head 12. The jam nut **19*a* is functionally the same as the jam nut previously shown. In this instance, it has an hexagonal longitudinal or axial bore 51. At one end it has a convex spherical shape 19*b* which contacts and bears against the ball 17 of the movable mounting means. The hexagonal bushing 52 is made so as to fit snugly within the hexagonal bore 51. The bushing 52 is drilled axially at 53. The drilling 53 is made to receive a roll pin 54 which is longer than the length of the drilling 53. The roll pin 54 is tapered at both ends sharply as designated by 55**.

When the jam nut is tightened with a hexagonal Allen wrench, which fits into the hexagonal opening 51, the jam nut **19*a* is tightened against the ball 17 as much as possible to hold the movable mounting means and the shaft 11 in the desired attitude and balanced position. To make this holding irreversible, the bushing 52 is hammered into the opening 51. Because of the tight engagement, it is almost impossible to remove the bushing 42 even at this stage. Next the roll pin 54 is positioned in the drilled hole 53 and driven through the bushing into contact with the substance of the ball 17. At this point the roll pin will flatten and level with the opening 53. Due to the differences in hardness between the pin 54 and the ball 17, the pin will penetrate into the substance of the ball and from that moment on, it will be impossible either to remove the pin or move the shaft and its mounting from its attitude and balanced position. Such a connection will withstand any use or misuse of the club without disturbing the precise configuration selected, even if the golfer leans on the club while picking the ball out of the cup. Likewise, pressure on the toe of the club cannot alter the final locking position. In this manner, the irreversible locking means provided achieves the desired goal through five separate elements, which goal has never been achieved before. The five elements are the ball 17, the socket 18, the jam nut 19*a*, the hexagonal bushing 52 and the roll pin 54. It also will be observed that the hexagonal bushing 52 and the hammered roll pin 54 completely and permanently fill the hexagonal opening 51 in the jam nut so that there is no way to nondestructively remove the bushing 52** and an Allen wrench can never again be used in the jam nut.

I claim:

1. The method of customizing a golf club used for putting, having a shaft and a head with a striking face, comprising the following steps, preparing said head with a movable joint for mounting said shaft, said movable joint extending from the top surface thereof, bending the shaft to provide a configuration with reverse curves at the lower end thereof adjacent the point of juncture with said head and a straight portion there above, said curves lying in the same axial plane of said shaft, permanently attaching said shaft on to the said movable joint of said head, moving the shaft and its movable joint as a unit with respect to said head to the adjusted attitude indicated by the desires of the user, balancing said club at its conventional balancing point adjacent the club head above said curves in the desired attitude adjusted position, axially rotating the permanently attached shaft and movable joint as a unit in the adjusted position until the said striking face of the head is face up and parallel to the ground establishing both the adjusted and balanced positions, and irreversibly securing the movable joint in the club head in the adjusted and balanced position.

2. The method of claim 1 the steps of providing a ball and socket as the adjustable mounting means for the shaft and providing a radial stub projection extending from the ball for permanently mounting the shaft.

3. The putter of claim 1 wherein the step of irreversibly positioning the shaft with respect to the head includes providing a jam nut having an axial longitudinal opening for receiving an Allen wrench, an hexagonal bushing for closely fitting into said axial opening, having an axial bore therethrough and also providing a roll pin longer than said axial bore to be received therein and driving said pin through said axial base into the substance of the movable joint means.

4. The method of adjusting a club head and shaft of a golf club for approved competitive use comprising the following steps, providing the head of said club with movable means for mounting a shaft, said means having a projection positioned to extend above the upper surface of said head and adapted to receive the end of shaft, permanently securing said shaft to said projection on said movable mounting means, moving the shaft and movable mounting means as a unit to an adjusted angular position of said shaft with respect to said head to meet the attitude needs and requirements of the user, and irreversibly securing the movable joint of the club head in the adjusted position.

5. The method of adjusting and balancing a club head and shaft of a golf club for approved competitive use comprising the following steps, providing the head of said club with movable means for mounting a shaft, said means having a projection positioned to extend above the upper surface of said head and adapted to receive the end of shaft, permanently securing said shaft to said projection on said movable mounting means, moving the shaft and movable mounting means as a unit to an adjusted angular position of said shaft with respect to said head to meet the attitude needs and requirements of the user, balancing the club longitudinally at its conventional balance point adjacent the head, maintaining the attitude adjusted position, axially rotating the permanently attached shaft and mounting means while maintaining the attitude position until the striking face of the head is face up and parallel to the ground, and irreversibly securing the mounting means in said head in the adjusted and balanced position.

6. The method of claim 5 including the steps of applying mechanical pressure against the mounting means as positioned in said head, and driving a pin into the substance of the mounting means to irreversibly secure the mounting means in said head in the adjusted attitude and balanced position.

* * * * *